United States Patent [19]

Touya et al.

[11] Patent Number: 4,924,548

[45] Date of Patent: May 15, 1990

[54] PORTABLE VACUUM CLEANER

[75] Inventors: Syouichi Touya; Hideki Kishi, both of Sumoto, Japan

[73] Assignee: Sanyo Electric Co., Ltd., Osaka, Japan

[21] Appl. No.: 82,825

[22] Filed: Aug. 6, 1987

[30] Foreign Application Priority Data

Aug. 8, 1986 [JP] Japan ..... 61-187277
Aug. 8, 1986 [JP] Japan ..... 61-187278

[51] Int. Cl.[5] ..... A47L 9/10; A47L 5/24

[52] U.S. Cl. ..... 15/347; 15/344; 15/353; 55/462; 55/465; 55/467; 403/322

[58] Field of Search ..... 15/344, 347, 353; 55/320, 462, 464, 465, 467, 307, DIG. 3; 403/322, 325, 328

[56] References Cited

U.S. PATENT DOCUMENTS

| | | | |
|---|---|---|---|
| 1,405,259 | 1/1922 | Beach | 55/464 X |
| 2,346,339 | 4/1944 | Vose | 55/320 X |
| 2,366,428 | 1/1945 | Scott | 55/320 X |
| 3,343,343 | 9/1967 | Doyle et al. | 55/320 |
| 4,341,540 | 7/1982 | Howerin | 55/307 |
| 4,513,470 | 4/1985 | Toya | 15/344 X |
| 4,536,914 | 8/1985 | Levine | 15/344 |
| 4,542,557 | 9/1985 | Levine | 15/344 |
| 4,561,868 | 12/1985 | von Reis et al. | 55/DIG. 3 X |
| 4,577,365 | 3/1986 | Yuen | 15/344 X |
| 4,610,048 | 9/1986 | Ishihara | 15/344 |

FOREIGN PATENT DOCUMENTS

| | | | |
|---|---|---|---|
| 156568 | 9/1982 | German Democratic Rep. | 15/344 |
| 1158152 | 7/1969 | United Kingdom | 15/344 |

*Primary Examiner*—Chris K. Moore
*Assistant Examiner*—Stephen F. Gerrity
*Attorney, Agent, or Firm*—Cohen, Pontani & Lieberman

[57] ABSTRACT

A portable vacuum cleaner for use in both dry and wet operations comprising a main body case housing a fan motor and having intake and discharge openings, a dust case having an intake portion and removably attached to the main body case around the intake opening, and a filter housing removably installed in the dust case and having a filter accommodated therein to cover the intake opening with the filter, the filter housing having a tubular portion projecting toward and substantially opposed to the intake portion of the dust case, the tubular portion being closed at the end opposed to the intake portion thereof and formed with apertures in its peripheral wall, the dust case having a partition wall positioned under the intake portion thereof and extending from the intake portion toward the main body case for separating off an interior lower portion of the dust case as a water collection chamber.

7 Claims, 14 Drawing Sheets

PORTABLE VACUUM CLEANER

BACKGROUND OF THE INVENTION

1. Field of the Invention

The present invention relates to a portable vacuum cleaner capable of drawing in both dust and water.

2. Description of the Prior Art

U.S. Pat. No. 4,542,557 (corresponding to Unexamined Japanese Patent Publication No. SHO 60-188124) and U.S. Pat. No. 4,536,914, for example, disclose portable vacuum cleaners for cleaning by drawing in dust as mixed with water. These conventional cleaners comprise a cleaner main body having a fan motor incorporated therein, a dust case attached to the front side of the main body and integral with a suction nozzle, and means housed in the dust case for separating water and dust from the air drawn in. To prevent the water drawn in from reversely flowing out from the suction nozzle, the suction nozzle is extending in the form of a tube under the upper wall of the dust case and having a rear end opening close to the front side of the main body. However, the suction nozzle, which is elongated, requires a fan motor having a very great suction force for drawing in heavy dirt or substances such as wet dust, pebbles and grit, rendering the cleaner costly to manufacture and necessitating increased power consumption. Especially when having a battery power source, the cleaner has the drawback that it is not usable for a sufficient period of time. Accordingly it appears desirable to shorten the suction nozzle to immediately direct dirt into the dust case, but it is then almost impossible to collect water, with the result that water must be dumped frequently.

SUMMARY OF THE INVENTION

The present invention provides a portable vacuum cleaner for use in both dry and wet operations which comprises a main body case housing a fan motor and having intake and discharge openings, a dust case having an intake portion and removably attached to the main body case around the intake opening, and a filter housing removably installed in the dust case and having a filter accommodated therein to cover the intake opening with the filter, the filter housing having a tubular portion projecting toward and substantially opposed to the intake portion of the dust case, the tubular portion being closed at the end opposed to the intake portion thereof and formed with apertures in its peripheral wall, the dust case having a partition wall positioned under the intake portion thereof and extending from the intake portion toward the main body case for separating off an interior lower portion of the dust case as a water collection chamber.

According to the present invention, the dust case is internally provided with a specific projecting partition wall for separating off an interior lower portion of the dust case as a water collection chamber. This permits use of a shortened suction nozzle and nevertheless gives the dust case an increased capacity to hold water therein, thereby eliminating the need to dump water frequently and rendering the cleaner convenient to use. The shortened suction nozzle enables the cleaner to make progress in a dust collection efficiency with reduced power consumption.

The partition wall provided in the dust case is so formed as to project form the intake portion toward the main body case.

According to the present invention, the end opposed to the intake portion of the tubular portion preferably has a surface irregularity. An example of such surface irregularity is preferably a projection formed approximately at the center of the end for preventing adhesion of dirt. Further preferably, such a projection is in the form of a solid cylinder.

DESCRIPTION OF THE PREFERRED EMBODIMENTS

Figure 1:
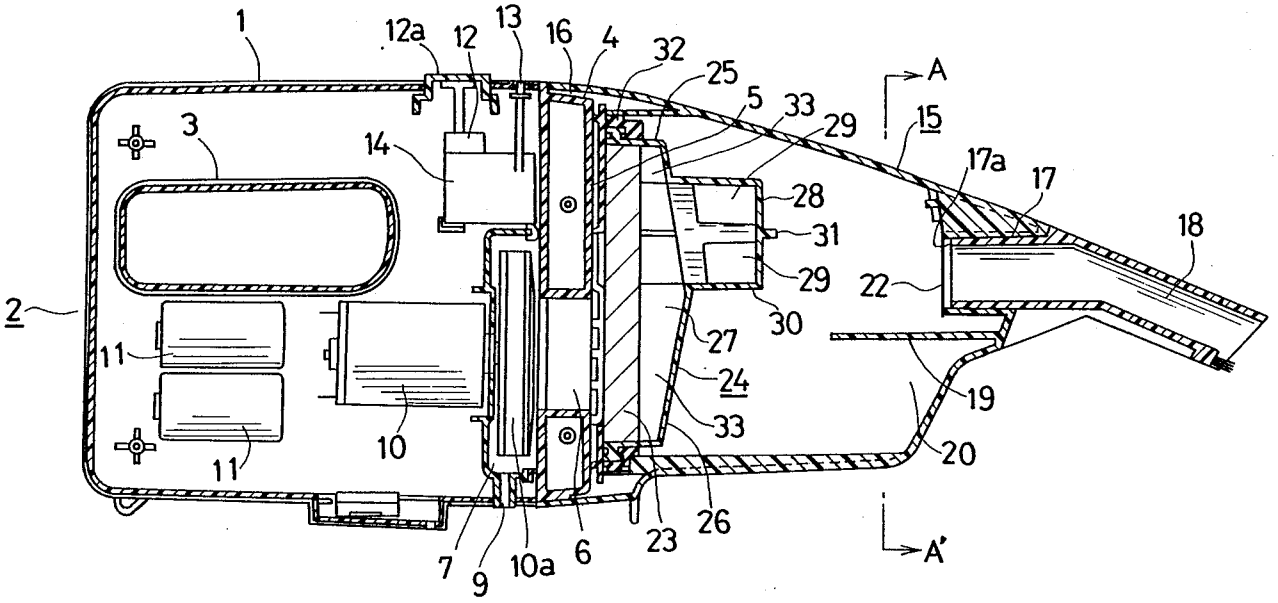
FIG. 1 is a sectional view showing a portable vacuum cleaner embodying the invention.
Figure 2:
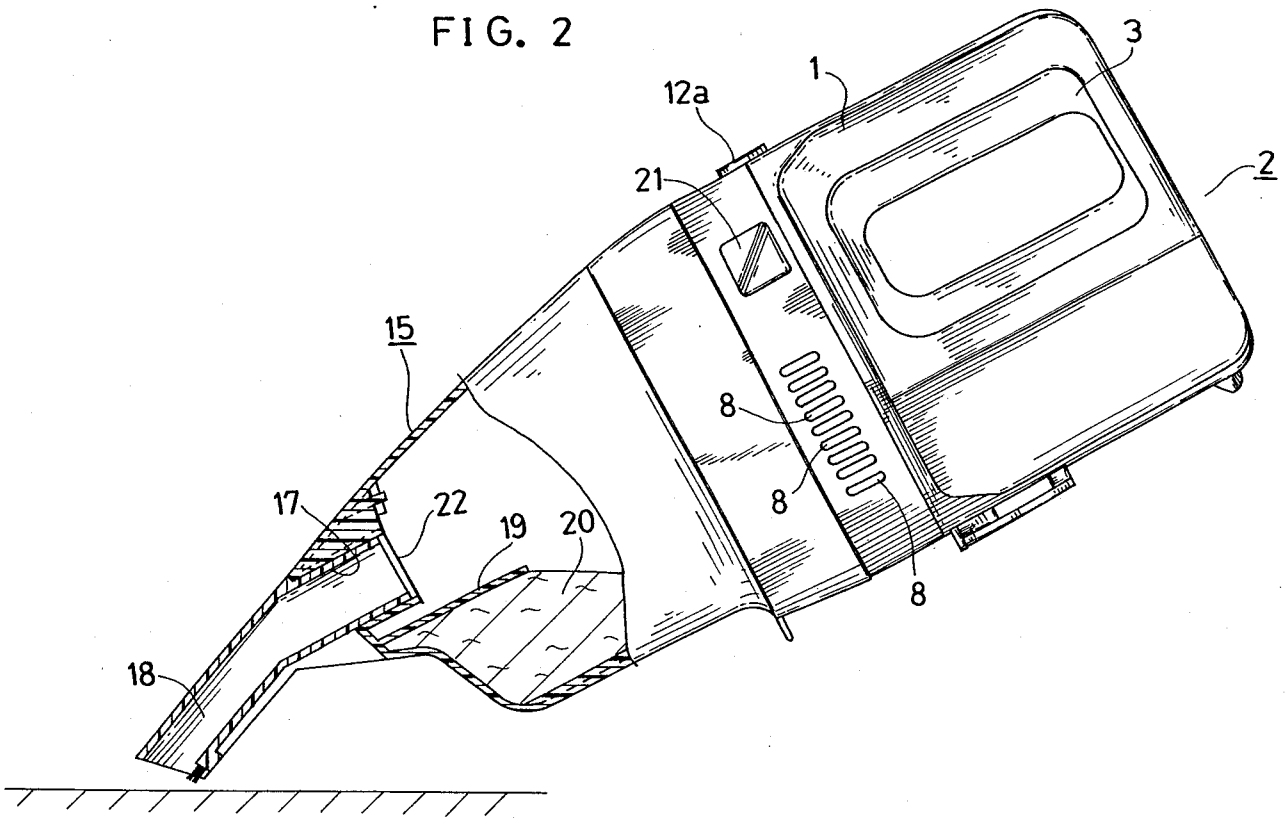
FIG. 2 is a side elevation partly broken away and showing the cleaner in use.
Figure 3A:
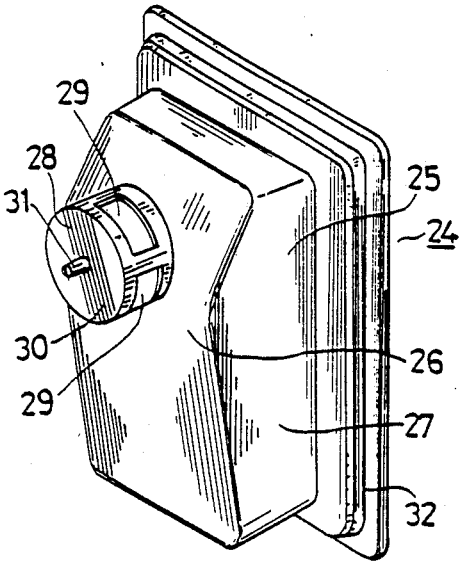
FIGS. 3 (*a*) and (*b*) are a perspective view and a side elevation, respectively, showing a filter housing.
Figure 3B:
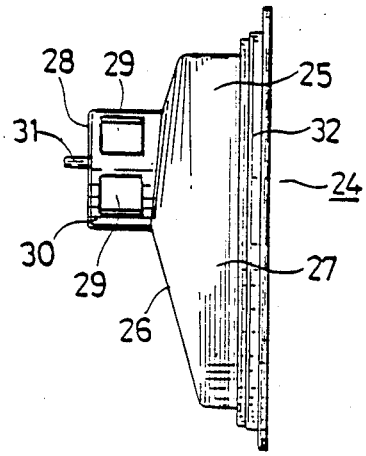
Figure 4:
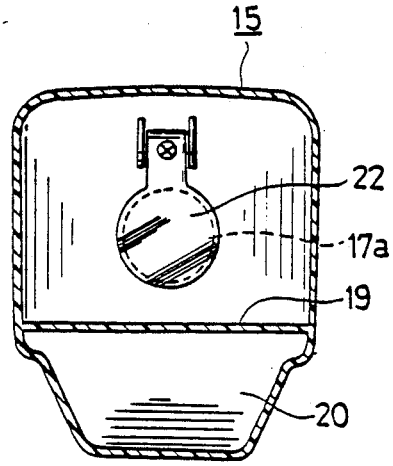
FIG. 4 is a view in section taken along the line A—A' in FIG. 1.

The portable vacuum cleaner of the invention basically comprises a main body case housing a fan motor and having intake and discharge openings, a dust case having an intake portion and removably attached to the main body case around the intake opening, and a filter housing removably installed in the dust case and having a filter accommodated therein to cover the intake opening with the filter. Alterations of the basic construction are not limited to the embodiments to be described below; the basic construction can be modified variously (see, for example, U.S. Pat. Nos. 4,142,270, 4,213,224, 4,341,540, 4,380,845, 4,577,365 and 4,536,914). Power source may be supplied to the fan motor from a rechargeable battery (cordless), or from a household receptacle connected directly to the motor by a cord (see U.S. Pat. No. 4,574,419, or for rechargeable power sources, see U.S. Pat. Nos. 4,225,814, 4,573,234 and 4,591,777).

A first embodiment will now be described.

With reference to FIGS. 1 to 4, a portable vacuum cleaner 2 includes a main body case 1 which has a handle 3 at its rear upper portion and a spigot portion 4 at its front side. The spigot portion 4 has a front wall 5 formed with an intake opening 6. A fan casing 7 communicating with the intake opening 6 is provided within the body case 1. Each of opposite side walls of the main body case 1 is formed with air discharge outlets 8 communicating with the fan casing 7 (see FIG. 2). The body case 1 is formed in its bottom wall with a drain port 9 communicating with the fan casing 7. The body case 1 houses a fan motor 10 provided with a centrifugal fan 10*a*which is rotatably disposed within the fan casing 7. Indicated at 11 are rechargeable batteries positioned below the handle 3 and housed in the case 1. A power supply switch 12 is also housed in the case 1, with its switch putton 12*a* projecting from the top of the case 1. Indicated at 13 is a light-emitting diode for indicating that the power supply is on, and at 14 a printed circuit board carrying a control circuit.

A dust case 15 removably attached to the front portion of the main body 2 is in the form of a tube having at its rear portion a socket opening 16 fitting to the spigot portion 4 and having a progressively decreasing diameter toward the front. The dust case 15 is adapted to hold therein dust or dirt, and also water, and further has at its front end a suction tube 17 serving as the above-mentioned intake portion. The dust case 15 is faired into a suction nozzle 18 of a large inlet opening which is removably joined to the suction tube 17. Under the open rear end 17*a* of the suction tube 17 within the dust case 15, a partition wall 19 ranging from the right side wall of the case 15 to the left side wall thereof extends substantially horizontally rearward toward the socket opening 16. An interior lower portion of the dust case 15 is separated off as a water collection chamber 20 by the partition wall 19. The water collected in the chamber 20 is prevented by the wall 19 from flowing out from the suction tube 17 when the main body 2 is forwardly inclinded during the use of the portable vacuum cleaner. The dust case 15 is held engaged with the main body 2 by a clamp device having a push button 21 (see FIG. 2). When the button 21 is depressed, the dust case 15 is releasable from the main body 2. The suction tube 17 has a check valve 22 of synthetic rubber plate.

A filter 23 for separating dirt from the air drawn in comprises a member made of chemically treated open-cellular urethane foam and having a large thickness. The filter 23 is removably accommodated in a filter housing 24, which comprises a filter accommodating portion 27 having an outer frame 25 and a front plate 26, and a tubular member 30 projecting forward from the central portion of the front plate 26 and having a bottom plate 28 at its front end for water and dirt to impinge thereon and air passing apertures 29 in its peripheral wall. The outer frame 25 extending along the outer periphery of the front plate 26 is shaped to fit in the dust case 15. The bottom plate 28 has a surface irregularity, i.e. a rib 31 provided at the center of its outer surface (see FIG. 3). The outer frame 25 has a seal member 32 along its outer edge. When the filter housing 24 is fitted into the dust case 15 through the socket opening 16, the filter 23 is so disposed as to cover the intake opening 6, with the surface of the bottom plate 28 opposed to the suction tube 17. The front plate 26 is provided on its inner side with holding plates 33 for the filter 23 which extend radially from the tubular member 30. The holding plates 33 serve also to smoothen the flow of air drawn in.

When the switch button 12*a* is depressed with the handle 3 of the main body 2 grasped by hand, power source is supplied from the rechargeable batteries 11, turning on the light-emitting diode 13 and rotating the fan motor 10 at a high speed. When the dirt to be removed is mixed with water, the dirt and the water are drawn in through the suction nozzle 18 along with air. The water and the dirt drawn into the dust case 15 collide with the bottom plate 28 of the tubular member 30 of the filter housing 24 are slowed down with respect to their flow speed, fall within the dust case 15 as separated form the drawn-in air and are collected therein. Since the suction tube 17 has a small length and has its rear end 17*a* left open inside the front end of the dust case 15, the distance the dirt drawn in is short, with the result that the dirt is immediately led into the dust case 15 by a small suction force even if including heavy substances such as pebbles or grit. The air drawn in is passed through the air apertures 29 and then through the filter 23 and directed into the fan casing 7 within the main body 2 via the intake opening 6. The air is thereafter discharged from the cleaner through the air outlets 8. Even if the separation by the bottom plate 28 is incomplete in the above operation, the filter 23 separates the water and fine dirt particles from the air stream. Further even if the filter 3 fails to completely remove the water, allowing some water to be drawn into the fan casing 7, the air discharging pressure of the fan 10*a* discharges the remaining water from the cleaner through the drain port 9. A large amount of water can be collected in the dust case 15 until the water level reaches the upper end of the water collection chamber 20 within the dust case 15, i.e. the partition wall 19.

The dirt and water are dumped after removing the dust case 15 from the main body 2 by depressing the push button 21 and removing the filter housing 24. The filter 23 is cleaned as removed from the filter housing 24. The batteries 11 are charged while the cleaner is not in use, using a battery-charger (now shown).

Accoring to the first embodiment described above, dirt mixed with water can be immediately drawn into the front portion of the dust case through the intake portion, so that the fan motor need not have a very great suction force and is therefore low in power consumption. Consequently, the cleaner having a battery power supply is usable for a long period of time. Since the dust case is adapted to hold water therein until the water level reaches the partition wall, the vacuum cleaner does not require frequent cubersome disposal of water and is accordingly convenient to use.

Further according to the first embodiment, the rib 31 provides a surface irregularity on the bottom plate 28, rendering wet litter or like waste fragments unable to snugly fit to the surface of the plate 28. This assures that dirt will effectively fall onto the bottom of the dust case 15 without adhering to the surface of the bottom plate 28, thereby almost completetly obviating the likelihood that the water kept in dirt will enter the main body through the filter while precluding the accumulation of dirt on the bottom plate 28 to enable the bottom plate to properly separate dirt from the drawn-in air over a prolonged period of time. Thus, the cleaner readily removes wet dust or dirt and is usable for wider application.

Next, a second embodiment of the invention will be described with reference to FIGS. 5 to 8.

Figure 5:
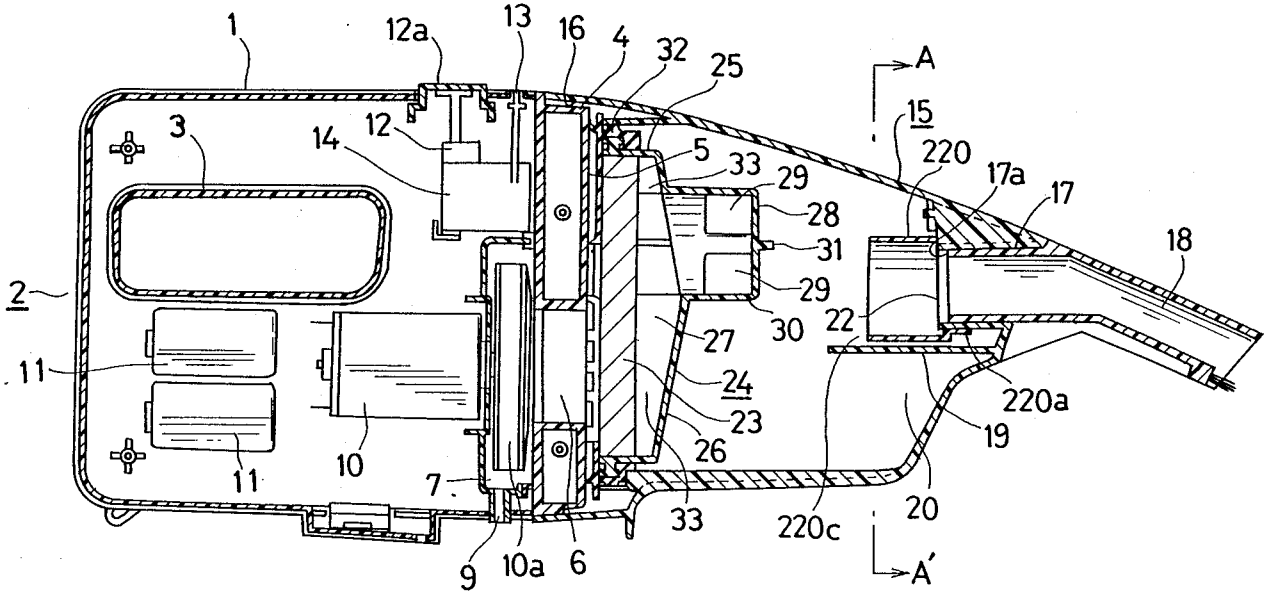
FIG. 5 is a view corresponding to FIG. 1 and showing another embodiment.
Figure 6:
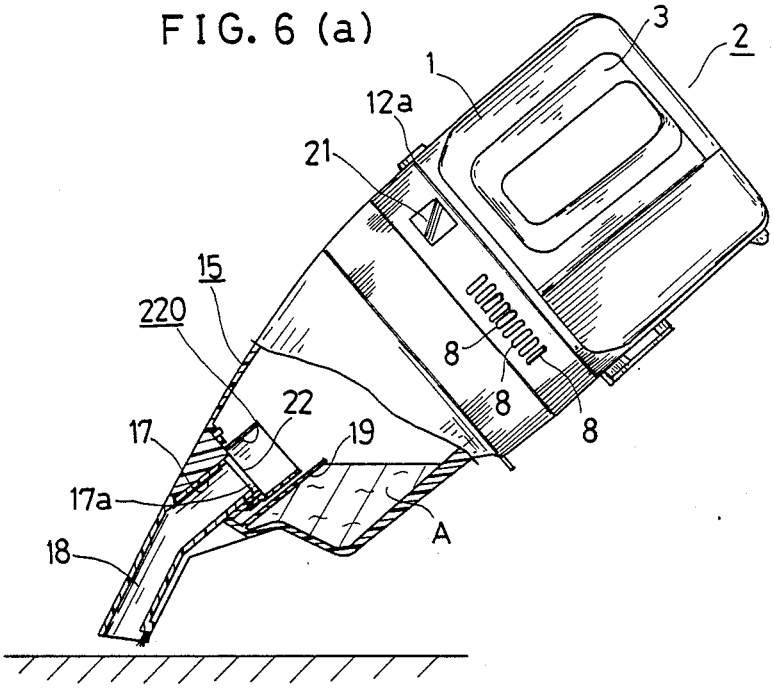
FIGS. 6 (*a*) and (*b*) are views corresponding to FIG. 2 and showing the second embodiment while in use in different states.
Figure 6:
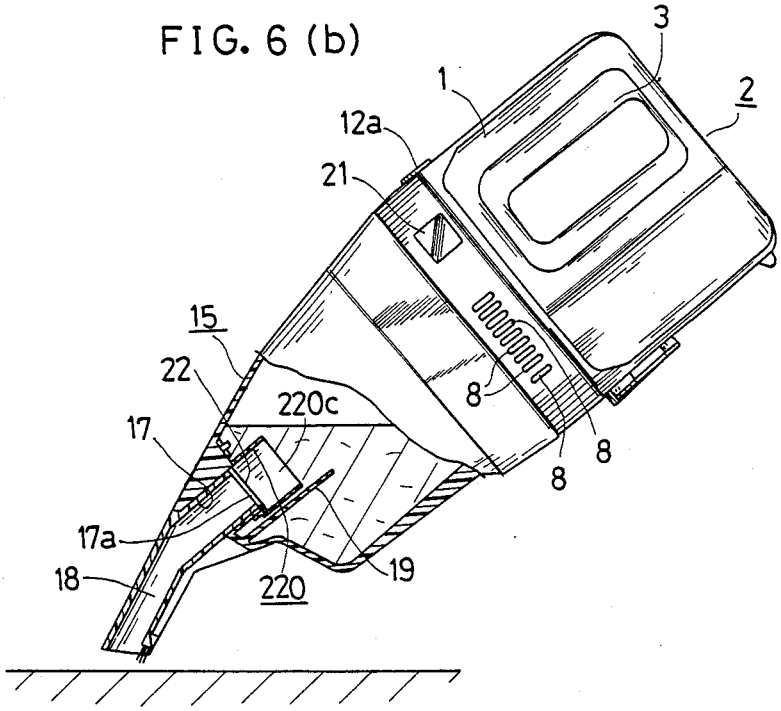
Figure 7:
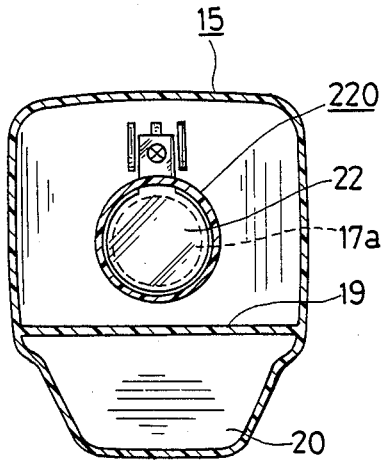
FIG. 7 is a view corresponding to FIG. 4 and showing the second embodiment.
Figure 8:
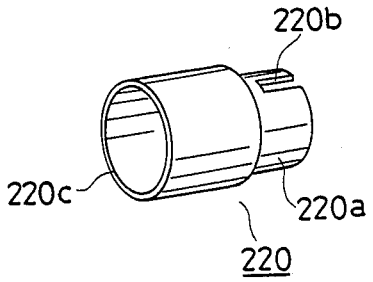
FIG. 8 is a perspective view showing a covering tube.
Figure 9:
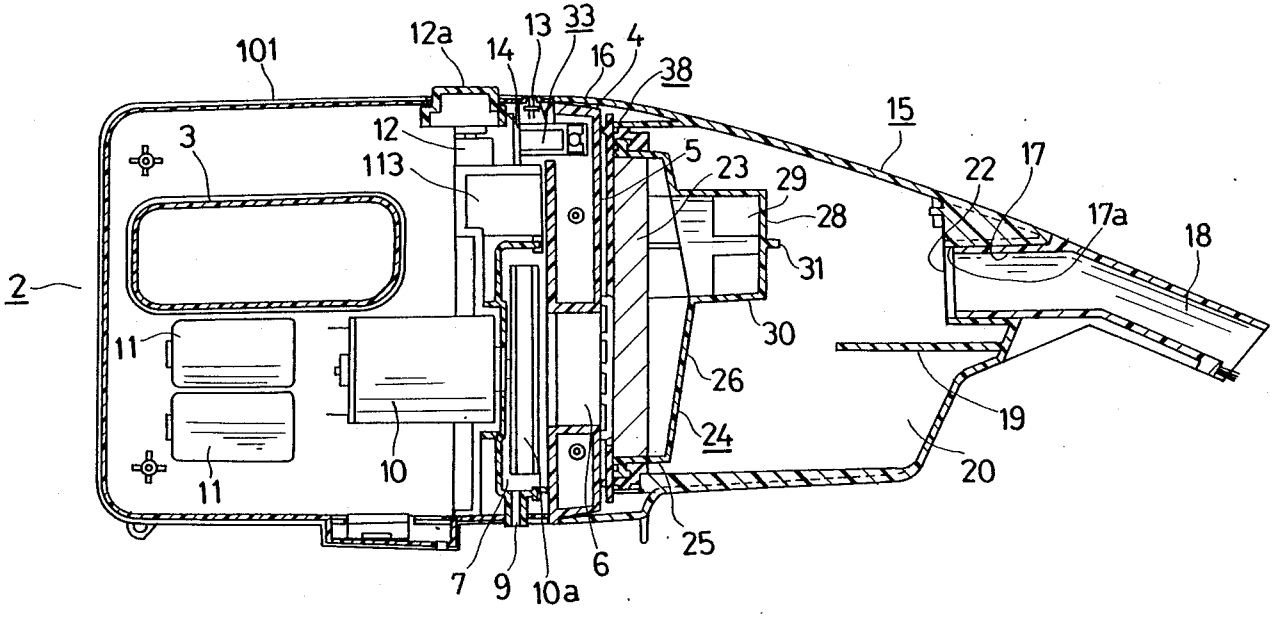
FIGS. 9 (*a*) and (*b*) are a sectional view and a perspective view, respectively, showing another embodiment in its entirety.
Figure 9:
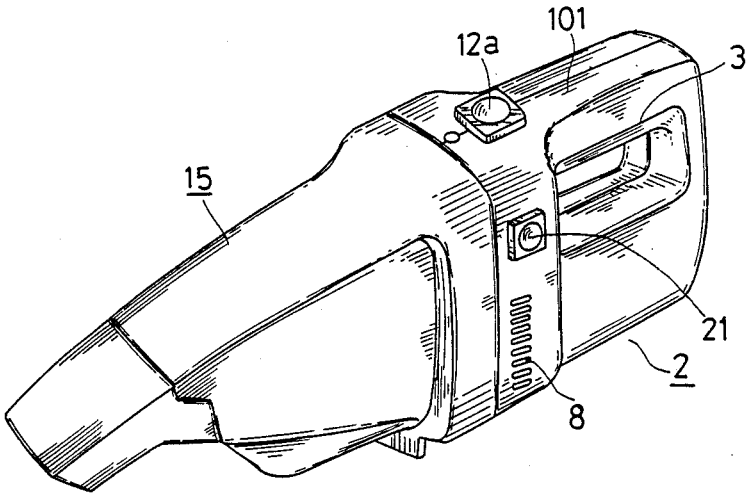
Figure 11:
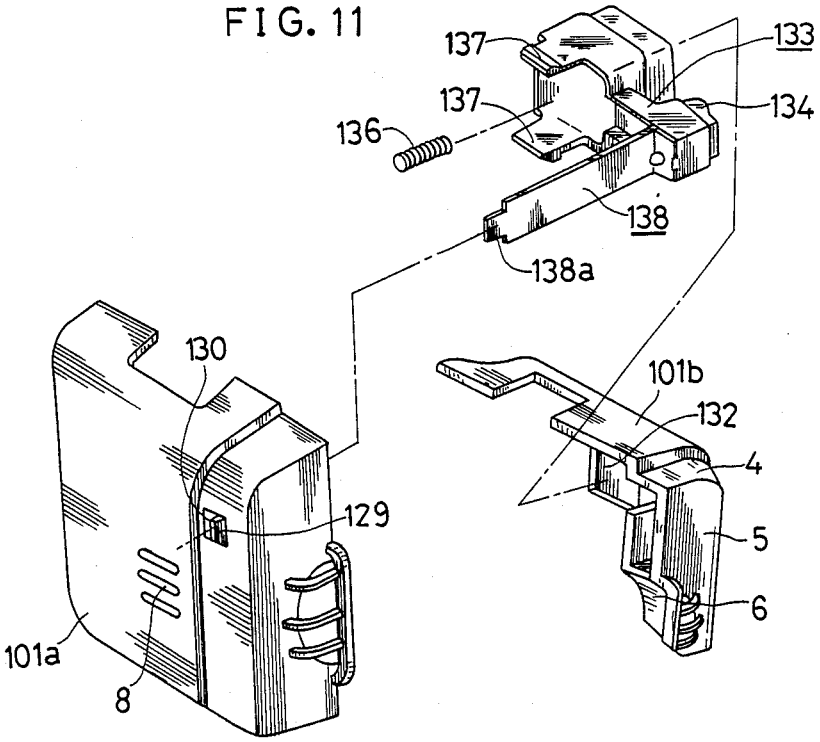
FIG. 11 is an exploded fragmentary perspective view showing the main body case.
Figure 10A:
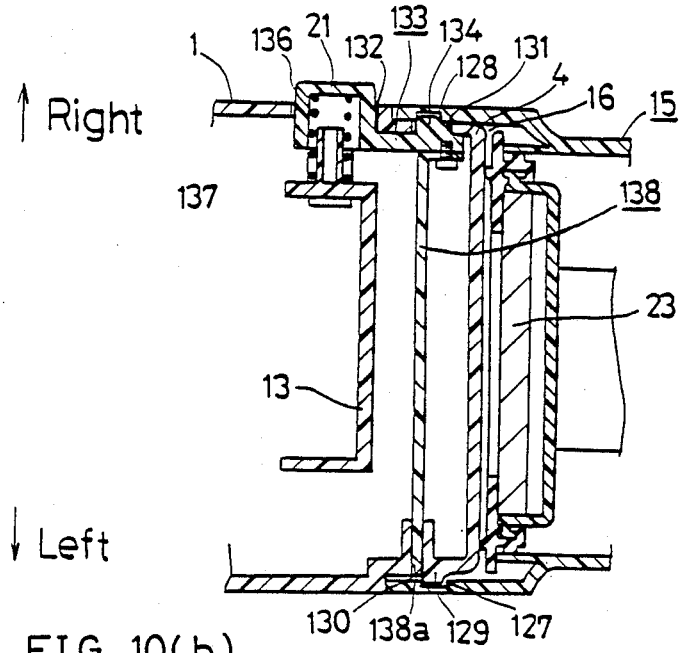
FIGS. 10 (*a*) and (*b*) are fragmentary views in horizontal section showing a main body case and a dust case as associated therewith according to the third embodiment.
Figure 10B:
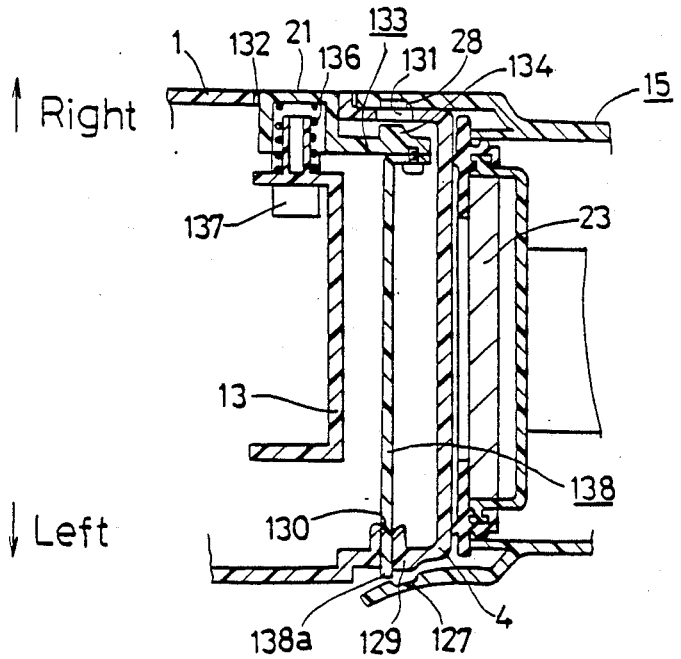
Figure 12B:
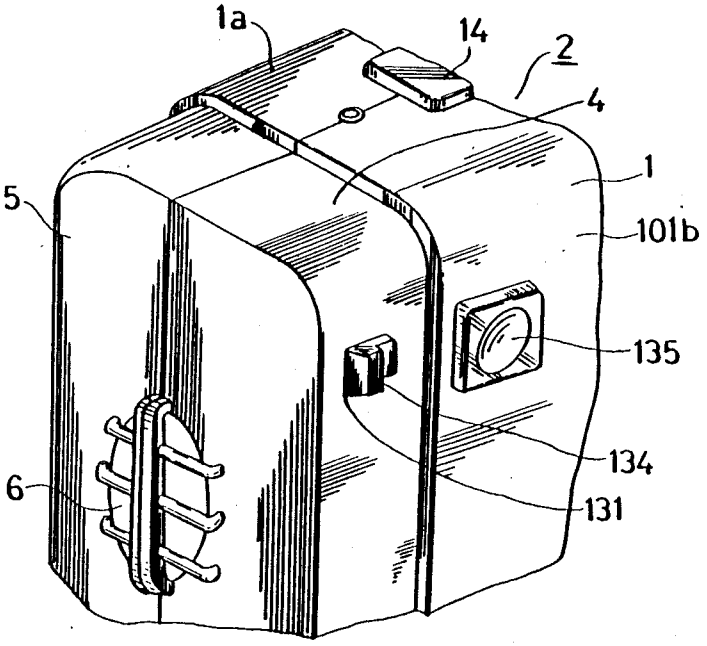
FIGS. 12 (*a*) and (*b*) are fragmentary perspective views showing the same as it is seen from the front at the right and left sides thereof, respectively.
Figure 12A:
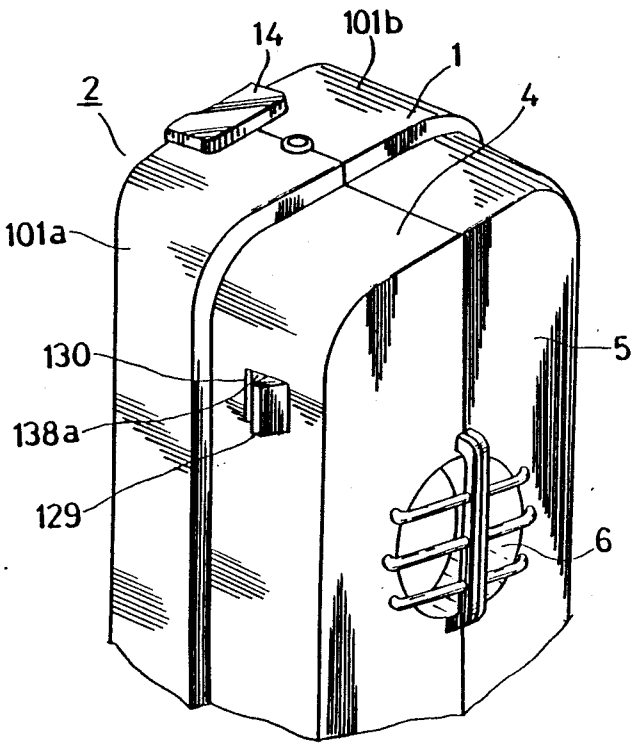

Throughout FIGS. 5 to 7, like parts are designated by like reference numerals and will not be described again. The open rear end 17*a* of the suction tube 17 is provided with a check valve 22 of synthetic rubber plate for rendering the open end 17*a* closable. A covering tube 220 is fitted and adhered to the open rear end 17*a*. The covering tube 220 is so sized as to openably accommodate the check valve 22 therein. The front fitted portion, which is indicated at 220*a*, has a cutout 220*b* for a support rib for the check valve 22 to fit in (see FIG. 8).

When the switch button 12*a* is depressed with the handle 3 of the main body 2 grasped by hand, power source is supplied from the rechargeable batteries 11, turning on the light-emitting diode 13 and rotating the fan motor 10 at a high speed. If the dirt to be removed is wet, the dirt and the water are drawn in through the suction nozzle 18 of a large inlet opening along with air. Since the check valve 22 is opened by the suction of the fan motor 10, the water and the dirt drawn into the dust case 15 through the suction tube 17 and the covering tube 220 impinge on the bottom plate 28 of the filter housing 24, whereupon the water and the dirt are slowed down with respect to their flow speed, separated from the drawn-in air, fall onto the bottom of the case 15 beyond the partition wall 19 and are collected therein. If the main body 2 is tilted forward with the inlet opening of the suction nozzle 18 directed while the cleaner is thus in use, water will collect between the partition wall 17 and the suction tube 17 (as indicated at A in FIG. 6 (*a*)), but the water will not reversely flow into the suction tube 17 until the water level reaches the open rear end 220*c* of the covering tube 220, since the rear end portion of the suction tube 17 is substantially extended rearward by the covering tube 220. Consequently, even if the cleaner is further used or is held out of use in this state, the water will reversely flow into the suction tube 17 (see FIG. 6 (*a*)). Moreover, even when the cleaner is carried around with the suction tube 17 directed downward and with a larger amount of water collected in the dust case 15 (see FIG. 6 (*b*)), the water within the covering tube 220 close to the suction tube 17 is restrained from moving by the wall of the covering tube 220, permitting the check valve 22 to remain closed without moving, although the entire body of water may be waved or swung. Consequently, no water leaks from the suction tube 17.

Thus, the dust case is adapted to collect a large amount of dirt therein as mixed with water or like liquid, while the cleaner is able to be carried around with the suction tube directed downward without permitting the water to greatly move in the vicinity of the check valve or to open the check valve. Accordingly, the cleaner which is adapted to hold a large quantity of liquid therein reduces the frequency of disposal of the liquid without permitting the liquid to reversely flow out from the suction tube to wet the floor or the like. The cleaner is therefore covenient to use.

The suction tube 17 communicates with the central portion of the dust case through the covering tube 220, so that the distance between the inlet opening of the suction nozzle 18 and the open rear end 220*c* of the covering tube 220 is smaller than in the cleaners of U.S. Pat. Nos. 4,536,914 and 4,542,557 although longer than in the embodiment of FIG. 1. Consequently, even heavy dirt including pebbles or grit can be drawn into the dust case 15 by a small suction force. The air drawn in flows into the filter housing 24 through the air apertures 29 and is passed through the filter 23 and then through the intake opening 6 into the fan casing 7 within the main body 2. The air is thereafter discharged from the cleaner through the air outlets 8. Even if the separation by the bottom plate 28 is incomplete in the above operation, the filter 23 separates the water and fine dirt particles from the air stream. Further even if the filter 23 fails to completely remove the water, allowing some water to be drawn into the fan casing 7, the air discharging pressure of the fan 10*a* discharges the remaining water from the cleaner via the drain port 9.

Thus, dirt wet with water or like liquid is drawn into the dust case straight toward the filter housing through the suction tube and the covering tube and can accordingly be so drawn in efficiently without necessitating an excess of power consumption for the fan motor. This enables the cleaner with a battery power supply to operate for a prolonged period of time.

The dirt and water are disposed after depressing the push button 21 to remove the dust case 15 from the main body 2 and removing the filter housing 24. The filter 23 is removed from the filter housing 24 and then cleaned. Using a battery-charger (not shown), the batteries 11 are charged while the cleaner is not in use.

A third embodiment of the invention will now be described.

Throughout FIGS. 9 to 12, like parts are designated by like reference numerals and will not be described again. A main body case 101 comprises left and right two divided case segments 101*a* and 101*b* providing the outer shell of vacuum cleaner main body 2. Indicated at 113 is a support having mounted thereon electric parts and devices including a fan motor 10.

The dust case 15 has a rear peripheral edge defining a socket opening 16. The opening-defining rear edge of the case 15 is fittingly joined to a spigot portion 4 of the main body 2 housing the fan motor 10, by the clamp device to be described below.

The rear edge of the dust case 15 defining the opening 16 has a first recess 127 and a second recess 128 serving as first and second engagement means and formed in the left and right inner surfaces, respectively, in opposed relation to each other.

An engaging projection 129 serving as latching means is provided on the spigot portion 4 of the main body case 1 at the left side portion thereof opposed to the first recess 127. A hole 130 is formed in the spigot portion 4 in the rear of the projection 129.

A pawl penetrating hole 131 is further folded in the spigot portion 4 of the main body case 1 at the right side portion thereof opposed to the second recess 128. A button penetrating hole 132 is formed in a side wall of the body case 1. An engagement holder 133 serving as holding means comprises an engaging pawl 134 and a push button 21 integral therewith and has lugs 137, 137 loosely inserted in the support 113 to retain the same, with a coiled spring 136 interposed between the rear side of the push button 21 and the support 113. The engaging pawl 134 is always biased by the spring to project from the spigot portion 4 through the pawl penetrating hole 31 into the second recess 128. The push button 21 is similarly biased to project from the side wall of the body case 1 through the button penetrating hole 132. A release bar 138 as releasing means connected to the push button 21 by being fixed with a screw to the rear side of the engagement holder 133 has a forward end 138*a* which is movable into or out of the hole 130. The release bar 138 has such a length that when the push button 21 is depressed, the end 138*a* projects through the hole 130 outward beyond the engaging projection 129. Thus, the depression of the push button 21 causes the bar end 138*a* to push the wall of the case 15 near the first recess 127, disengaging the projection 129 from the first recess 127.

Accordingly, the dust case 15 is deformed to engage the projection 129 into the first recess 127 and the pawl 134 of the holder 133 into the second recess 128 merely by fitting the open rear end 16 of the dust case 15 to the spigot portion 4 of the body case 1, whereby the dust case 15 can be readily joined to the cleaner main body 2.

On the other hand, the push button 21 on the holder 133, when depressed, releases the pawl 134 from the second recess 128 into the spigot portion 4 while projecting the forward end 138*a* of the release bar 138 through the hole 130 outward beyond the engaging projection 129 to push the wall of the dust case 15 and release the projection 129 from the first recess 127. The dust case 15 is easily removable from the cleaner main body 2 when pulled in this state.

Thus according to the present embodiment, the dust case can be properly joined to the cleaner main body by the simple procedure of merely fitting the rear opening edge of the dust case to the spigot portion of the cleaner main body, while the push button, when merely depressed, releases the latching means from the first engaging means and the holding means from the second engaging means at the same time to render the dust case readily removable from the cleaner main body.

Accordingly, the dust case is easy to attach to the cleaner main body and to remove therefrom, and the cleaner is convenient to use.

Figure 13:
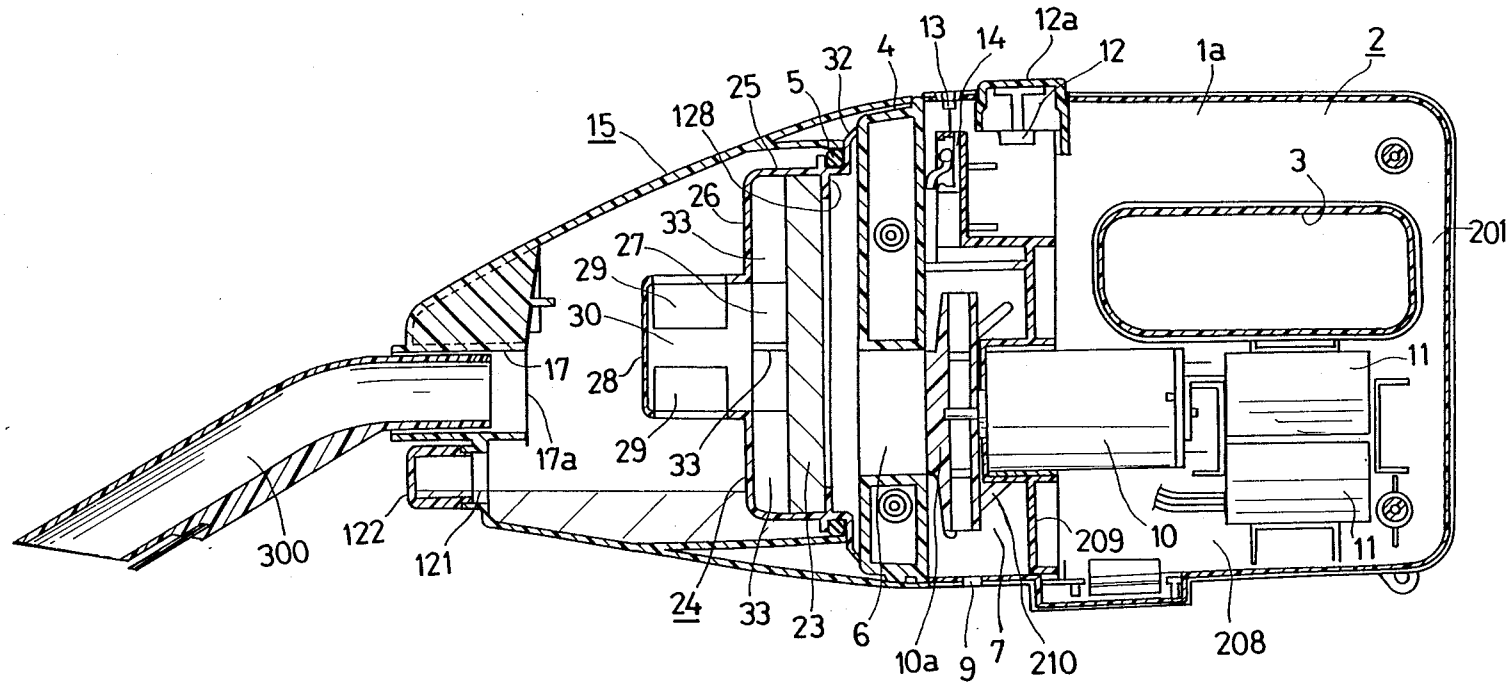
FIGS. 13 (*a*) and (*b*) are a sectional view and a perspective view, respectively, showing another embodiment in its entirety.
Figure 13:
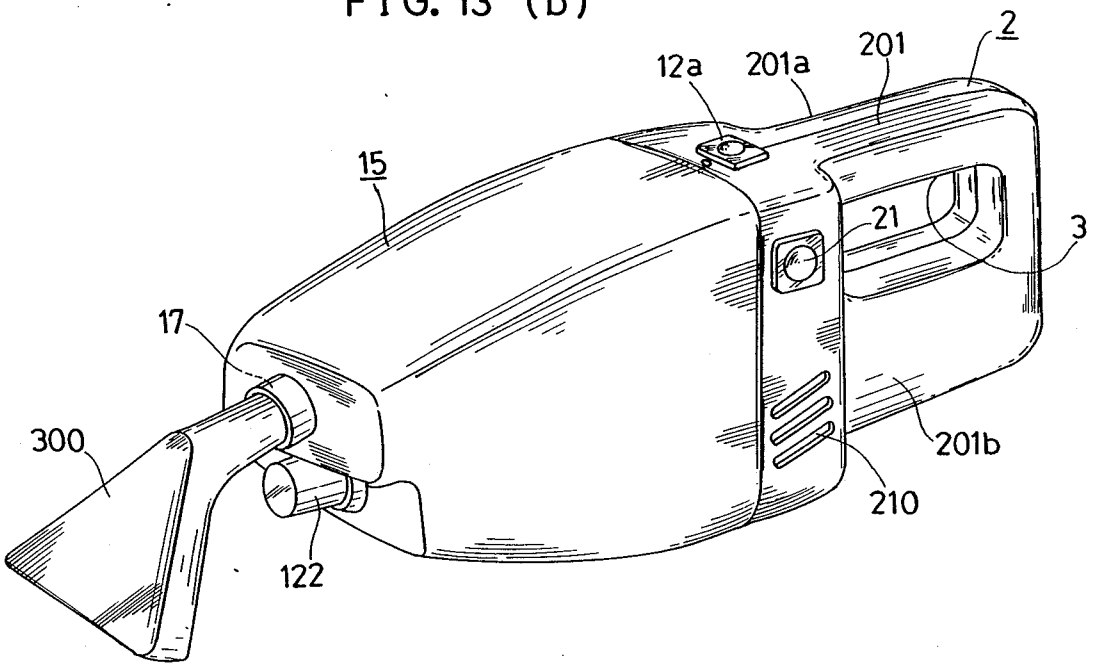
Figure 14:
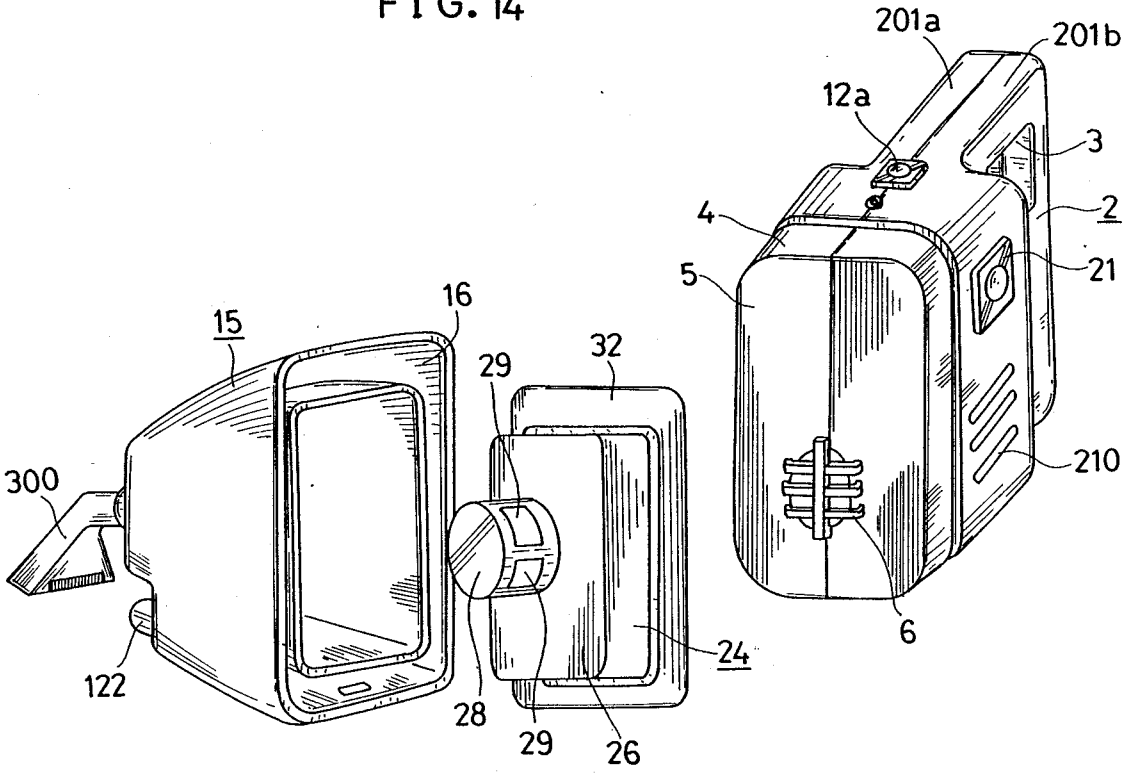
FIG. 14 is an exploded perspective view showing the fourth embodiment in its entirety.
Figure 15:
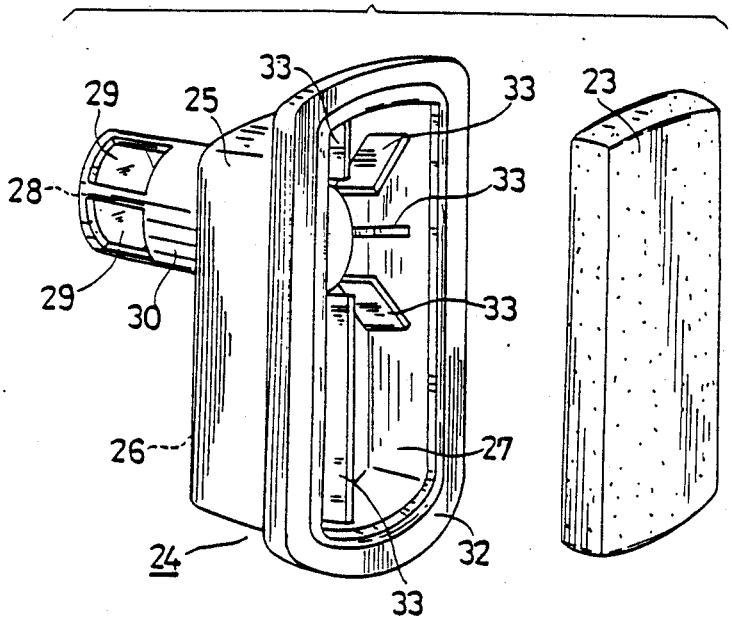
FIG. 15 is an exploded perspective view showing a filter housing included in the fourth embodiment.

With reference to FIGS. 13 to 15, a cleaner main body 2 has a body case 201, which comprises a pair of left and right divided case segments 201*a* and 201*b*. In the interior of the main body case 201, a fan casing 7 communicating with the intake opening 6 is separated from a device accommodating chamber 208 by a partition plate 209. A fan motor 10 and rechargeable batteries 11 are disposed in the chamber 208. A light-emitting diode 13 and printed circuit board 14 are fixed to the portion of the partition plate 209 positioned above the fan casing 7. The opposite side walls of the body case 201 which provide the fan casing 7, i.e., the opposed case segments 201*a*, 201*b*, are formed with air outlets 210. The air drawn into the main body 2 through the intake opening 6 is passed through the fan casing 7 and discharged from the cleaner via the air outlets 210 almost without entering the device accommodating chamber 208.

The suction tube 17, which is removably provided with a suction nozzle 300 of increased width, may alternatively be equipped with a suction nozzle of different shape for cleaning a particular place. A drain hole 121 is formed in a front end portion of the dust case 15 under the suction tube 17. The drain hole 121 is removably provided with a screwed-in the transparent cap 122. The filter 23 comprises a platelike member of open-cellular urethane foam which has been chemically treated. The filter housing 24 comprises a filter accommodating portion 27 having an outer frame 25 fittable into the dust case 15, a front plate 26 covering the front side of the housing and a flange extending along the rear edge of the outer frame 25 for preventing the filter 23 from slipping off; and a tubular member 30 projecting forward from the central portion of the front plate 26 and having a bottom plate 28 at its front end for water and dirt to impinge thereon and air passing apertures 29 in its peripheral wall. A seal member 32 extending along the outer frame 25 is formed outward from its rear edge.

The front plate 26 is provided on its rear side with holding plates 33 for holding the filter 23 which extend radially extended from the tubular member 30. The holding plates 30 serve also to smoothen the flow of air drawn in and to distribute the air over the entire front area of the filter 23.

When the switch button 12*a* is depressed with the handle 3 of the main body 2 grasped by hand, power is supplied from the rechargeable batteries 11, turning on the light-emitting diode 13 and rotating the fan motor 10 at a high speed. When the dirt to be removed is mixed with water, the dirt and the water are drawn in through the suction nozzle 300 along with air. The water and the dirt drawn into the dust case 15 impinge on the bottom plate 28 of the tubular member 30 of the housing 24, whereupon they are slowed down with respect to their flow speed, separated from the drawn-in air, fall onto the bottom of the dust case 15 and are collected therein. The draw-in air enters the filter housing 24 through the air apertures 29, are directed radially outward by the filter holding plates 33 arranged radially and are thereby uniformly distributed over the entire surface of the filter 23, whereupon the air passes through the filter 23, is led into the fan casing 7 within the main body 2 via the intake opening 6 and is discharged from the cleaner through the air outlets 8. Even if the separation by the bottom plate 28 is incomplete, the water and fine dirt particles are separated from the air stream by the filter 23, while the drawn-in air passes through the filter 23 as distributed over the entire front surface of the filter 23, without permitting clogging of the filter 23 but assuring a high suction efficiency over a prolonged period of time. The filter holding plates 33 which distribute the drawn-in air and smoothen the air flow prevent occurrence of eddy flows, precluding occurrence of noise that could result from eddy flows. Even if the filter 23 fails to completely separate off the water, permitting some water to be drawn into the fan casing 7, no water will flow into the device accommodating chamber 208, whereby the fan motor 10 and the batteries 11, etc. are protected from water. The water in the fan casing 7 is forced out from the cleaner via the drain port 9 by the centrifugal fan 10*a*. Since the water collected in the dust case 15 can be observed through the transparent cap 122, the dust case 15 can be readily drained when removed from the main body 2 after use. This eliminates the likelihood that the cleaner will be stowed away with water held therein.

The dirt is disposed after depressing the push button 21 to remove the dust case 15 from the main body 2 and removing the filter housing 24. The filter 23 is removed from the housing 24 and then cleaned. While the cleaner is not in use, the batteries 11 are charged using a battery-charger (not shown).

Figure 16:
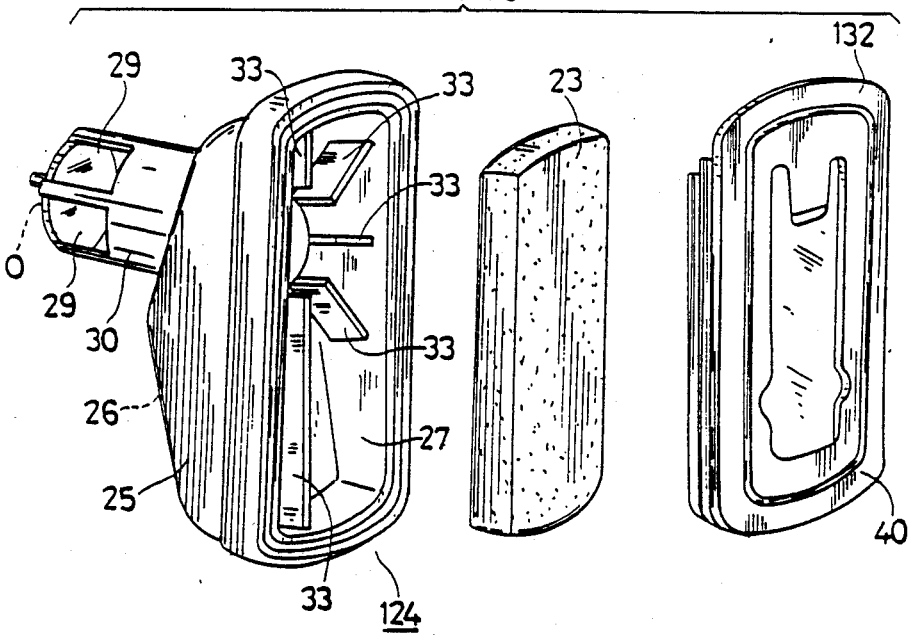
FIG. 16 is a view corresponding to FIG. 15 and showing another filter housing.

FIG. 16 shows another embodiment of filter housing indicated at 124. Throughout several drawings showing the filter housings 24 and FIG. 16, like parts are referred to by like numerals and will not be described again. With reference to FIG. 16, the housing 124 has a filter accommodating portion 27 and a rear frame 40 which is to be attached to the rear open side of the housing and which is provided with a seal member 132 extending along the outer periphery of the rear frame 40 and fittable into the dust case 15. The filter 23 is held in place between the filter holding plates 33 in the accommodating portion 27 and the rear frame 40.

With the present embodiment, water and large pieces of dirt or litter fall within the dust case upon striking on the bottom plate of the filter housing, so that the portion of dirt failing to fall is separated from the drawn-in air by the filter. The air drawn into the filter housing is diffused over the entire front surface of the filter by the filter holding plates before passing through the filter, rendering the filter less prone to clogging, permitting the filter to achieve a high dust removal efficiency over a long period of time and reducing the frequency of cleaning the filter. Moreover, wet dirt is removable by the filter. The vacuum cleaner is therefore usable for wider application.

What is claimed is:

1. A portable vacuum cleaner for use in both dry and wet operations, comprising:

a main body case housing a fan motor and having intake and discharge openings therefor, said intake opening being disposed about a first axis;

a dust case having an intake portion and removably attached to the main body case around said intake opening; and a filter housing removably installed in said dust case, said filter housing having a filter accommodating portion wherein a filter is accommodated to cover said intake opening, said filter accommodating portion including a front plate and a frame provided along the outer periphery of said front plate, said front plate having a tubular portion projecting therefrom and disposed about a second axis, said tubular portion being substantially opposed to the intake portion of said dust case, the second axis of said tubular portion being out of alignment with the first axis of the intake opening, and wherein the front plate further includes filter holding plates provided on the side of said front plate opposite the tubular portion, said filter holding plates being radially arranged from the second axis of the tubular portion so as to direct drawn-in air over the entire front surface of the filter;

said tubular portion being closed at an end opposed to said intake portion thereof and formed with apertures therethrough, and said dust case having a partition wall positioned under the intake portion thereof and extending from said intake portion toward said main body case for defining a water collection chamber at an interior lower portion of the dust case.

2. A cleaner as defined in claim 1, further comprising a projection formed on and substantially at the center of said end of the tubular portion for preventing adhesion of dirt.

3. A cleaner as defined in claim 2 wherein the projection is subtantially in the form of a cylinder.

4. A cleaner as defined in claim 1 wherein the tubular portion is circular in cross section.

5. A cleaner as defined in claim 1 wherein the intake portion is provided in its opening with a check valve for preventing reverse flow of drawn-in air.

6. A cleaner as defined in claim 5 wherein the intake portion is provided at its opening with a tube for covering the check valve.

7. A cleaner as defined in claim 1 wherein the main body case includes a spigot portion and the dust case has a rear edge defining a socket opening and fittingly attached to said spigot portion of the main body case by a clamp device, the clamp device comprising first and second engaging means opposed to each other and formed in the inner surface of the opening-defining rear edge of the dust case, latching means provided on one side of the spigot portion and engageable with the first engaging means, holding means provided in the main body case and biased to project from the other side of the spigot portion into engagement with the second engaging means, the holding means having a push button for disengaging the holding means from the second engaging means, and a releasing means connected to the push button for disengaging the latching means from the first engaging means when the push button is depressed.

* * * * *